US006802136B2

(12) United States Patent
Merchant

(10) Patent No.: US 6,802,136 B2
(45) Date of Patent: Oct. 12, 2004

(54) BEVERAGE POUCH DRYER

(76) Inventor: Scott T. Merchant, 120 S. Gwinner, Ithaca, MI (US) 48847

( * ) Notice: Subject to any disclaimer, the term of this patent is extended or adjusted under 35 U.S.C. 154(b) by 0 days.

(21) Appl. No.: 10/427,247

(22) Filed: May 1, 2003

(65) Prior Publication Data

US 2003/0226278 A1 Dec. 11, 2003

Related U.S. Application Data

(60) Provisional application No. 60/376,894, filed on May 1, 2002.

(51) Int. Cl.[7] ..... F26B 25/06

(52) U.S. Cl. ..... 34/104; 34/201; 34/239; 34/218; 34/437; 34/440

(58) Field of Search ..... 34/207, 239, 104, 34/439, 440, 582, 105, 106, 179, 180, 181, 201, 218, 437

(56) References Cited

U.S. PATENT DOCUMENTS

| | | | | | |
|---|---|---|---|---|---|
| 684,741 | A | | 10/1901 | Bowman | |
| 4,265,030 | A | | 5/1981 | Smallegan | 34/104 |
| 4,768,293 | A | * | 9/1988 | Kaffka | 34/104 |
| 5,058,289 | A | * | 10/1991 | Guindon | 34/104 |
| 5,287,636 | A | * | 2/1994 | Lafleur et al. | 34/104 |
| 5,406,717 | A | * | 4/1995 | Dofka | 34/104 |
| 5,943,786 | A | | 8/1999 | Stahley | 34/106 |
| 5,984,680 | A | * | 11/1999 | Rogers | 433/173 |
| 6,516,536 | B2 | * | 2/2003 | Ryden | 34/106 |
| 6,553,687 | B1 | * | 4/2003 | Leamon, Jr. | 34/104 |
| 6,688,019 | B2 | * | 2/2004 | Buchweitz | 34/106 |

* cited by examiner

*Primary Examiner*—Kenneth Rinehart
(74) *Attorney, Agent, or Firm*—Gifford, Krass, Groh, Sprinkle, Anderson & Citkowksi, P.C.

(57) ABSTRACT

The present invention provides an apparatus and method for drying the interior of a flexible beverage container. The apparatus includes a housing having an inlet and outlet. A blower is disposed intermediate between the inlet and outlet and is operative to draw air through the housing via the inlet and outlet. An exhaust pipe is disposed at the outlet whereby the container may be disposed thereon for drying. The dryer is operative to blow air onto the farmost inner portions of the container to facilitate thorough and hygienic drying between uses.

9 Claims, 1 Drawing Sheet

BEVERAGE POUCH DRYER

RELATED APPLICATION

This application claims priority of U.S. Provisional Patent Application Ser. No. 60/376,894 filed May 1, 2002, which is incorporated herein by reference.

FIELD OF THE INVENTION

The present invention relates to an apparatus and related method for drying the interior of a container, and in particular to an apparatus and related method for drying the interior of a flexible beverage pouch.

BACKGROUND OF THE INVENTION

For millenniums beverages have been transported in flexible pouches. These pouches have traditionally been formed from animal skins, tissue membranes and water-impervious coating impregnated cloths. More recently, these materials have been supplanted by plastic. While the size of a beverage pouch was traditionally limited by the structural performance and seepage associated with natural materials, the advent of plastic pouch materials allowed for the creation of larger beverage pouches. Such large, flexible beverage pouches have been embraced by endurance athletes such as runners, bicyclists, skiers, and mountaineers. Exemplary of these strap-on flexible beverage containers are those manufactured by Camel Bak Products (Petaluma, Calif.).

A longstanding problem associated with flexible beverage containers persists to this day, namely, the difficulty with drying the container between uses. The emptying of a flexible beverage container tends to cause the opposing walls to collapse into contact thereby trapping residual moisture therebetween. The constant moisture and other conditions found within a beverage container create a suitable environment for the growth of algae, fungus, and microbes.

Prior art drying apparatus have failed to address flexible beverage container hygienic drying as being principally directed to industrial scale drying, unique article geometries, pulsatile drying, or involving steam injection. Thus, there exists a need for a flexible beverage container drying apparatus.

SUMMARY OF THE INVENTION

The present invention addresses the need for a flexible beverage container drying apparatus that has particular utility for drying the interior after use.

The flexible container drying apparatus is comprised of a housing that includes air inlet and outlet openings. A blower is provided intermediate between the inlet and outlet for drawing air into and forcing air out of the inlet and outlet openings respectively.

An exhaust pipe is disposed at the air and extends within a 45 degree angle of vertical. The exhaust pipe is dimensioned such that the diameter of the pipe fits within an opening of the beverage container and the length of the pipe is sufficient to suspend a flexible beverage container therefrom. When the container is suspended on the exhaust pipe in an inverted fashion, the blower is operable to blow air onto the innermost portions of the container accomplishing thorough and hygienic drying in between uses.

BRIEF DESCRIPTION OF THE DRAWINGS

The present invention will be better understood by reference to the followed detailed description in conjunction with the accompanying drawing in which like reference characters refer to like parts throughout and in which.

DETAILED DESCRIPTION OF THE PREFERRED EMBODIMENTS

Figure 1:
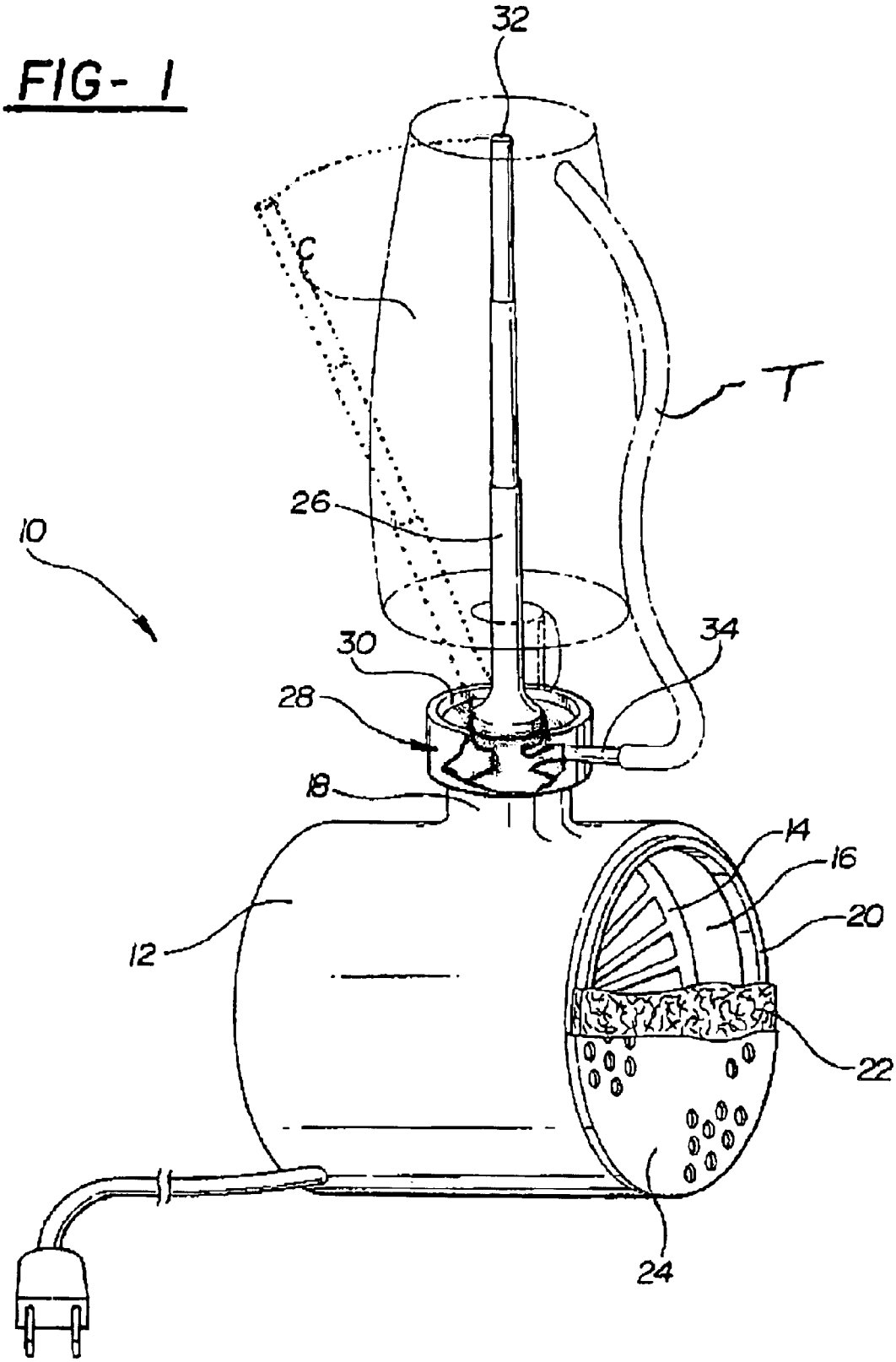
FIG. 1 is a partial cutaway perspective view of an inventive drying apparatus.

The present invention has utility as a drying apparatus for a flexible beverage container. The present invention is derived from the identification of the problem that passive air drying of a flexible beverage container is inadequate in a conventional usage setting. By blowing filtered air onto the farmost inner portions of a flexible beverage container suspended with beverage container outlet therebelow, thorough and hygienic drying is achieved. Although the inventive dryer herein is described for use with a flexible beverage container, it is appreciated that the blower may be similarly used with non-flexible beverage containers.

Referring now to FIG. 1, a flexible beverage container drying apparatus is shown generally at 10. The drying apparatus 10 includes a housing 12 encasing an electric blower motor 14. The housing 12 is configured to form an air inlet 16 and an air outlet 18. The housing 12 has a flange 20 intermediate between the inlet 16 and the blower motor 14. The flange 20 is adapted to receive a high efficiency particulate air (HEPA) filter 22. A protective cover 24 permitting the passage of air therethrough optionally covers the filter 22. It is appreciated that other types of filters may be used for such purpose that illustratively include ultra low penetration air (ULPA) and anti-bacterial filters.

The blower motor 14 is typically from 250 to 3000 watts in power. While the blower motor optionally includes a heating element (not shown), heated air is provided only with great care in order to avoid localized deformation to the flexible beverage container C. In instances where an inventive drying apparatus includes a heating element, the temperature of the air exiting therefrom and into contact with the beverage container C is preferably less than 90° Celsius. More preferably, the heated air is less than 70° Celsius. Optionally, the blower motor 14 may be disposed with a variable heating element control operative to allow the user to adjust the temperature of the heated air to a desired level.

In an alternate embodiment, the blower motor is manually rotated by way of gearing and a hand crank (not shown). It is appreciated that a manually powered blower motor is well suited for operation of the present invention in remote or wilderness environments. Other alternative sources of power may include battery power, solar cell power, or gas power.

The outlet 18 receives an exhaust pipe 26 therein. The exhaust pipe 26 being at least the length of a beverage container C. The exhaust pipe 26 preferably extends from the housing 12 at an angle ranging from vertical to about 45 degrees from vertical although less angles are appreciated to be operative herein. More preferably, the exhaust pipe 26 is mounted within 5 degrees of vertical. Preferably, a coupling 28 having a catch basin portion 30 resides intermediate between the outlet 18 and exhaust pipe 26. The basin 30 tends to collect moisture evacuated from the beverage container C and thereby lessen moisture intercalation into the housing 12. While it is appreciated that the exhaust pipe 26 optionally includes apertures bored along the length thereof to facilitate diffuse drying air emission, in the preferred embodiment, the exhaust pipe 26 only has an air exhaust opening 32 at the apex of the exhaust pipe 26. Still further, a resiliently flexible exhaust diffuser may be disposed at the exhaust end of the exhaust opening 32 for diffusing the exhaust air over a wider area to further reduce the risk of heat damage to the container C. In order to create a more compact inventive drying apparatus, it is appreciated that the exhaust pipe 26 is optionally formed in telescoping sections. Alternatively, the coupling 28 may be designed for direct attachment to a complementary coupling, such as a male or female threaded fastener, disposed at the opening of the container C as an option to using the exhaust pipe 26.

In order to dry a flexible beverage container having a withdrawal tube, either the outlet 18 or the exhaust pipe 26 is fitted with a nipple 34 adapted to mate with the withdrawal tube T of a flexible beverage container C. Superior drying of a beverage container C including a withdrawal tube T is accomplished by supporting the beverage container C on the exhaust tube 26 and coupling the free end of the withdrawal tube T to the nipple 34. Upon activation of the blower motor 14, air is forced back through the withdrawal tube T into the main body of the beverage container C with a positive pressure relative to the air emitted from the end of the exhaust tube 26 and being forced generally downward towards the inverted opening of the beverage container C and carrying humidity therewith.

One skilled in the art upon reading the specification will appreciate changes and modifications that do not depart from the spirit of the invention. These changes and modifications and equivalents thereof are intended to be encompassed within the scope of the appended claims.

I claim:

1. A drying apparatus for a flexible beverage container comprising:

a housing having an air inlet and an outlet;

a blower motor within said housing intermediate between the air inlet and the outlet;

an exhaust pipe formed of telescoping sections and having a diameter and an extended length, the diameter sufficient to fit within an opening of the container and the length sufficient to suspend a flexible beverage container therefrom; and a nipple adapted to couple to a withdrawal tube of the flexible beverage container, said nipple in gaseous communication with said blower motor.

2. The apparatus of claim 1 wherein said blower motor is electrically powered.

3. The apparatus of claim 1 wherein said blower motor is manually powered.

4. The apparatus of claim 1 wherein said exhaust pipe extends within a 45 degree angle of vertical.

5. The apparatus of claim 1 further comprising a coupler intermediate between the outlet and the exhaust pipe, said coupler having a fluid collecting annulus.

6. The drying apparatus of claim 1 further comprising a HEPA filter intermediate between the air inlet and said blower motor.

7. A process for drying a flexible beverage container comprising the steps of:

inverting the beverage container over an exhaust pipe;

filtering air through a HEPA filter to yield filtered air;

forcing the filtered air through said exhaust pipe and into the beverage container; and forcing air through a nipple and into a withdrawal tube of the beverage container simultaneous with forcing air through said exhaust pipe.

8. The process of claim 7 wherein the filtered air is heated to a temperature of not more than 90° Celsius.

9. The process of claim 7 wherein said exhaust pipe extends within a 45 degree angle of vertical.

* * * * *